US012408711B2

(12) United States Patent
Mazzarolo et al.

(10) Patent No.: US 12,408,711 B2
(45) Date of Patent: Sep. 9, 2025

(54) GARMENT COMPRISING AN INFLATABLE PROTECTION DEVICE

(71) Applicant: ALPINESTARS RESEARCH S.P.A., Maser (IT)

(72) Inventors: Giovanni Mazzarolo, Coste di Maser (IT); Lorenzo Nardo, Ponzano Veneto (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 0 days.

(21) Appl. No.: 17/311,090

(22) PCT Filed: Dec. 4, 2019

(86) PCT No.: PCT/EP2019/083720
§ 371 (c)(1),
(2) Date: Jun. 4, 2021

(87) PCT Pub. No.: WO2020/115158
PCT Pub. Date: Jun. 11, 2020

(65) Prior Publication Data

US 2021/0329986 A1 Oct. 28, 2021

(30) Foreign Application Priority Data

Dec. 5, 2018 (IT) ..... 102018000010828

(51) Int. Cl.
*A41D 13/018* (2006.01)
*A41D 13/05* (2006.01)
(Continued)

(52) U.S. Cl.
CPC ..... *A41D 13/018* (2013.01); *A41D 13/0587* (2013.01); *A41D 31/145* (2019.02); *A41D 31/185* (2019.02)

(58) Field of Classification Search
CPC ..... A41D 13/018; A41D 13/0587
See application file for complete search history.

(56) References Cited

U.S. PATENT DOCUMENTS 3,096,635 A * 7/1963 John, V ..... D04B 1/22 66/170
4,397,046 A * 8/1983 Steiner ..... A41D 13/018 2/908
(Continued)

FOREIGN PATENT DOCUMENTS

EP 2621297 A1 4/2012
EP 3498117 A1 6/2019
(Continued)

OTHER PUBLICATIONS

PCT International Search Report and Written Opinion dated Dec. 20, 2019 for Intl. App. No. PCT/EP2019/083720, from which the instant application is based, 9 pgs.
(Continued)

*Primary Examiner* — Katherine M Moran
(74) *Attorney, Agent, or Firm* — Fredrikson & Byron, P.A.

(57) ABSTRACT

A garment (1) comprising an inflatable protection device (10) and a housing (2), the inflatable protection device (10) comprising at least one inflatable bag (12) housed in the housing (2) and designed to move between a rest condition, where it is in a deflated status and an operating condition, where it is in an inflated status and inflation means (14) connected with the inflatable bag (12) and designed, once triggered, for selectively inflating the inflatable bag (12). The at least one inflatable bag (12) is manufactured with an elastic material and, in said rest condition, occupies a limited portion of said housing (2).

19 Claims, 6 Drawing Sheets

Figure 1A:
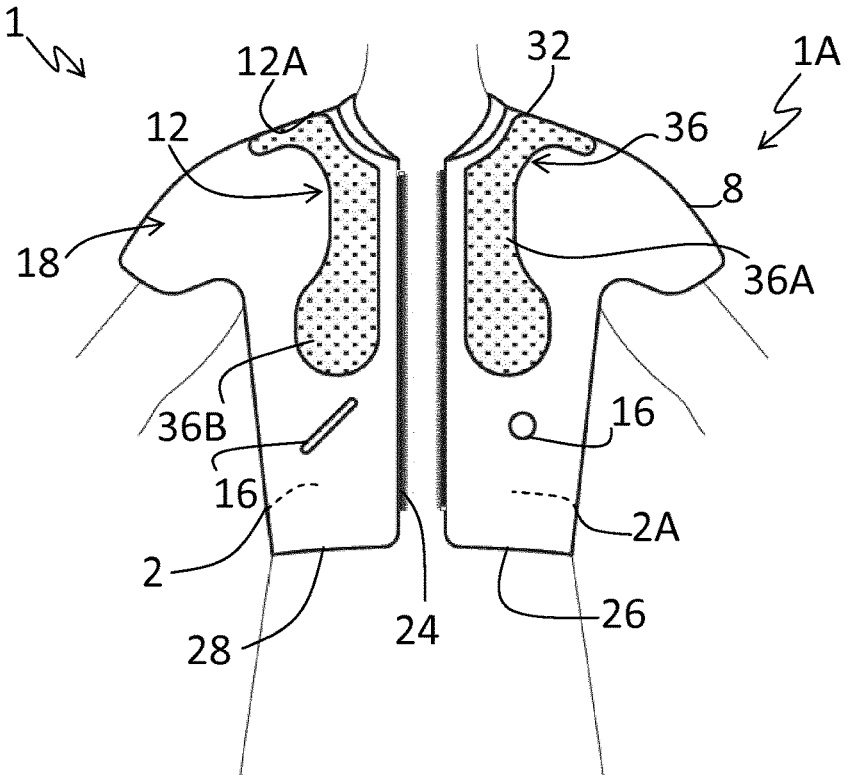

(51) Int. Cl.
*A41D 31/14* (2019.01)
*A41D 31/18* (2019.01)

(56) References Cited

U.S. PATENT DOCUMENTS

| | | | | |
|---|---|---|---|---|
| 4,737,994 | A * | 4/1988 | Galton | A41D 13/0506 2/DIG. 3 |
| 6,951,033 | B2 * | 10/2005 | Dainese | A41D 13/018 2/69 |
| 8,910,319 | B2 * | 12/2014 | Dainese | A41D 13/0155 2/456 |
| 9,775,389 | B2 * | 10/2017 | Azzolin | A41D 1/04 |
| 2008/0178370 | A1 * | 7/2008 | Orita | A41D 13/018 2/455 |
| 2012/0023648 | A1 * | 2/2012 | Dainese | A41D 13/0155 2/463 |
| 2012/0073035 | A1 | 3/2012 | Mazzarolo et al. | |
| 2015/0128334 | A1 * | 5/2015 | Mazzarolo | A41D 13/018 2/466 |
| 2016/0088883 | A1 * | 3/2016 | Azzolin | A41D 13/018 2/455 |
| 2017/0340472 | A1 | 11/2017 | Turner | |
| 2021/0212392 | A1 * | 7/2021 | Piovesan | A41D 13/018 |
| 2021/0360993 | A1 * | 11/2021 | Mazzarolo | A41D 13/018 |
| 2022/0361598 | A1 * | 11/2022 | Mazzarolo | A41D 13/018 |
| 2022/0361600 | A1 * | 11/2022 | Mazzarolo | G01M 3/3218 |

FOREIGN PATENT DOCUMENTS

| | | | |
|---|---|---|---|
| JP | 2007070782 | A | 3/2007 |
| KR | 1020150023422 | A | 3/2015 |
| KR | 1020150077409 | A | 7/2015 |
| NO | 2008044222 | A2 | 4/2008 |
| WO | 2011055461 | A1 | 5/2011 |
| WO | 2011148350 | A1 | 12/2011 |
| WO | 2011148353 | A1 | 12/2011 |
| WO | 2013001494 | A1 | 1/2013 |
| WO | 2015181734 | A1 | 12/2015 |
| WO | 2017163196 | A1 | 9/2017 |

OTHER PUBLICATIONS

Italian Search Report and Written Opinion with English Translation dated Jul. 11, 2019 for Italian Application No. 102018000010828, 7 pgs.

Societa Italiana Brevetti Intellectual Property, "Third Party Observation for European Application No. EP3890537", Dated Oct. 30, 2024, pp. 1-15.

* cited by examiner

GARMENT COMPRISING AN INFLATABLE PROTECTION DEVICE

RELATED APPLICATIONS

This application is a 35 U.S.C. 371 national stage filing from International Application No. PCT/EP2019/083720, filed Dec. 4, 2019, which claims priority to Italian Application No. 102018000010828, filed Dec. 5, 2018, the teachings of which are incorporated herein by reference.

FIELD OF THE INVENTION

The present invention relates to a garment comprising an inflatable protection device. In particular, even though not exclusively, the present invention relates to a protective garment suitable for being worn by a motorcyclist, a cyclist or a skier.

BACKGROUND

For simplicity sake, in the continuation of the description, reference will be made to a protective garment suitable for being worn by a motorcyclist, such as a jacket, a riding suit or a vest suitable in turn to be worn with a suit or a jacket.

It is well known that these protection garments can be provided with an inflatable protection device which comprises one or more inflatable bags (also called "airbags") incorporated in the structure of the garment.

In particular, each inflatable bag can be positioned inside a suitable housing formed within the layers of the garment or in a pocket integrated in the garment.

In the rest condition, the bag is in a deflated status while in the operating condition the bag is in an inflated status. Actually, in the case of a danger situation for the rider, as for example a crash or an impact, the bag is designed to be inflated by suitable inflation means.

The inflation means are connected to a control unit for receiving a triggering signal in the case of a danger situation. Further, a plurality of sensors, connected to the control unit, is provided on the garment or on the vehicle for detecting the status of the user, namely the movements and the accelerations undergone by the user.

When the sensors detect some kind of anomaly, the control unit triggers the inflation means and the bag is inflated.

The known airbags are usually made of fabrics or membranes with low stretchability.

This means that the shape of the airbag must be sized so as to have dimensions able to assure the covering of the portion of the body to be protected.

Moreover, the airbags moving from their rest condition to their operating condition undergo a lateral contraction, due to their inflation. Therefore, to assure an adequate protection, the airbags often are designed with larger sizes so as to compensate the lateral contraction.

However, even if the use of airbags has improved the safety level offered to the rider, the garments provided with inflatable protection devices are not devoid of drawbacks.

First of all, the airbags, occupying a large area of the garment in which are installed, reduce the transpiration and the breathability of the garment. In other words, the provision of an airbag inside a garment reduces the possibility that the moisture and vapours produced by the user's body are released. Therefore, there is the risk that during the use of the garment the riders feel overheating or discomforted.

Moreover the airbags, due to their large dimensions, reduce the flexibility of the garment and increase the weight thereof.

BRIEF SUMMARIES OF OBJECTS OF THE INVENTION

An object of the present invention is to provide a garment comprising an inflatable protection device which allows to solve the above mentioned drawbacks.

In particular, an aim of the present invention is to provide a garment comprising an inflatable protection device having an improved breathability.

Another aim of the present invention is to provide a garment with an inflatable protection device which is lighter than the known garments provided with airbags.

A further aim is to provide a garment with an inflatable protection device which is more comfortable to be worn by the user.

These and other objects and aims are achieved by a garment with an inflatable protection device as claimed in claim 1.

BRIEF DESCRIPTIONS OF THE DRAWINGS

Figure 1B:
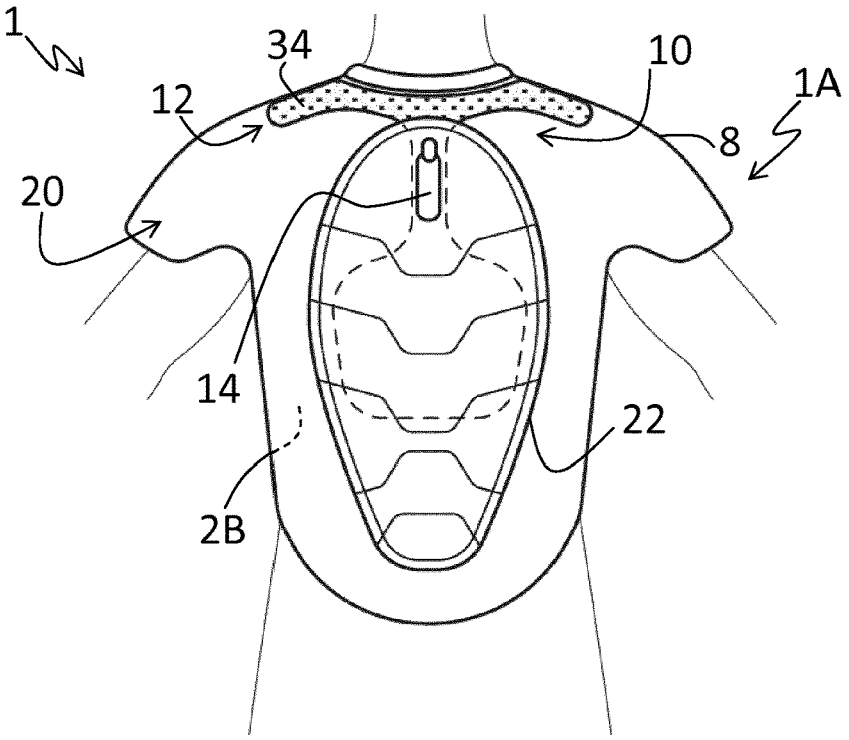
Figure 2A:
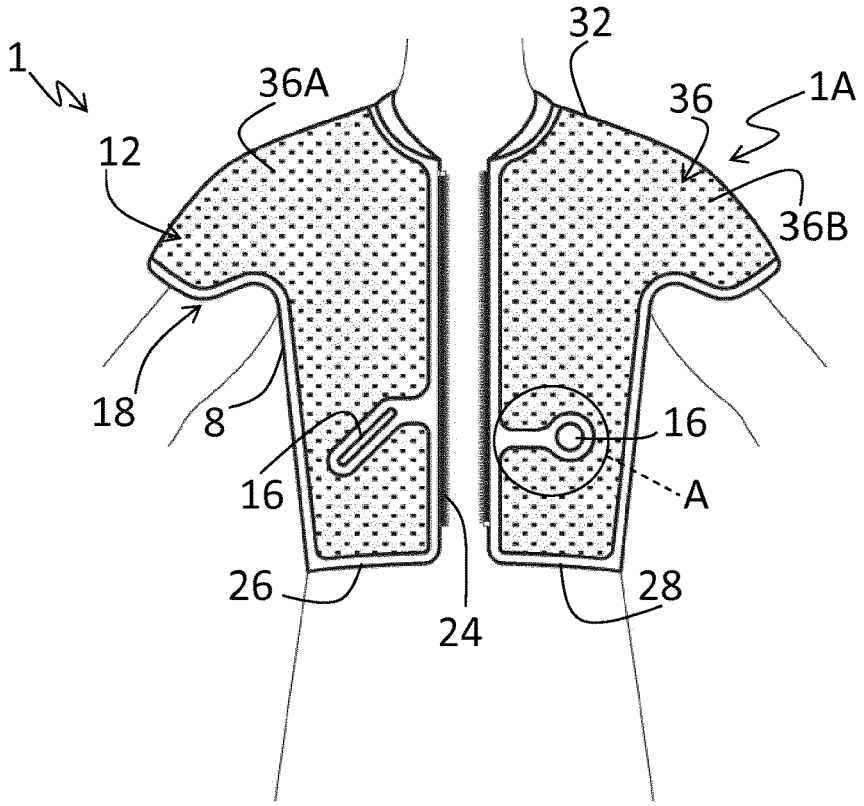
Figure 2B:
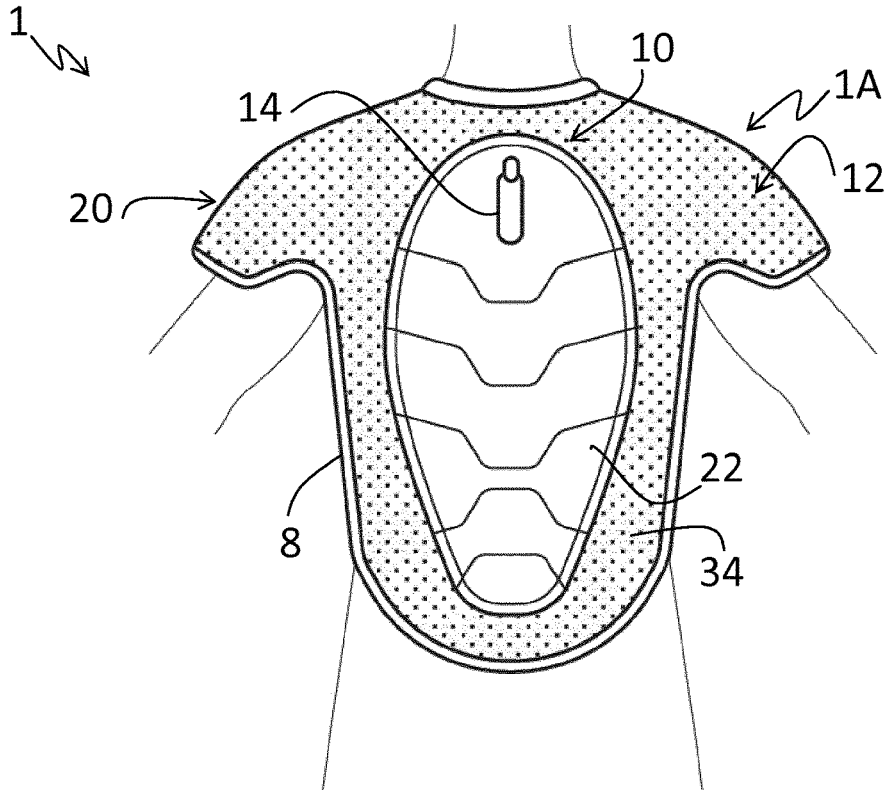
Figure 3A:
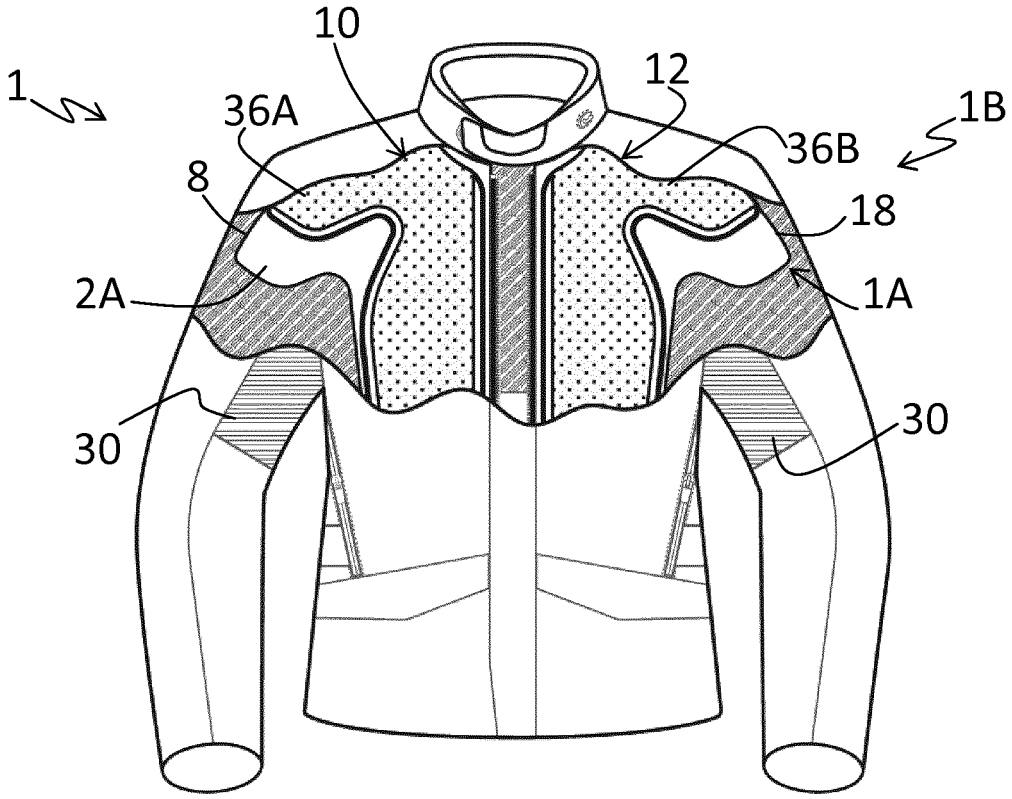
Figure 3B:
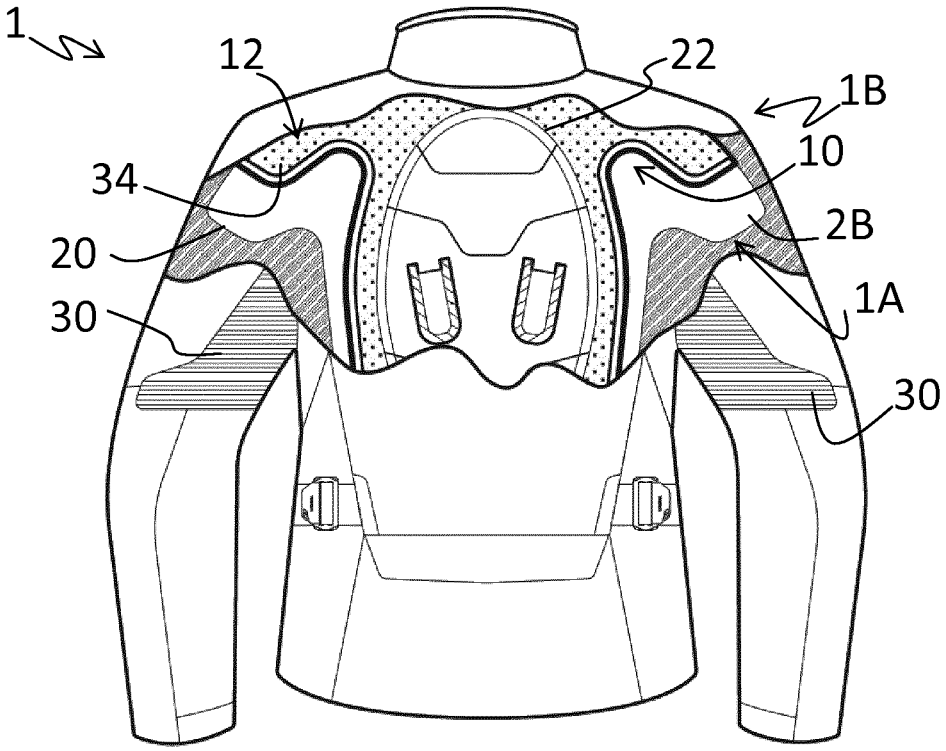
Figure 4A:
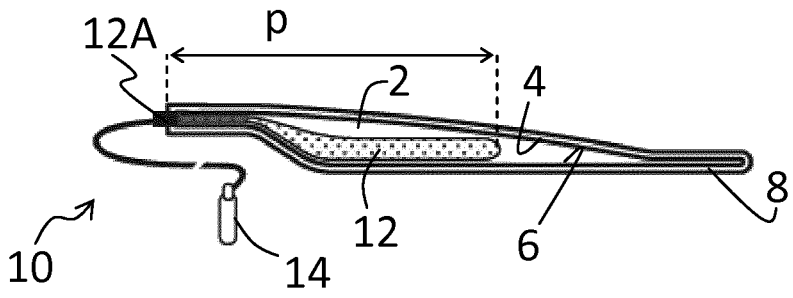
Figure 4B:
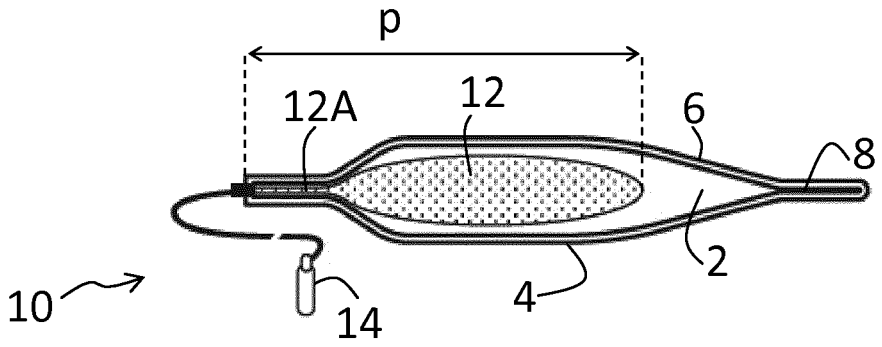
Figure 4C:
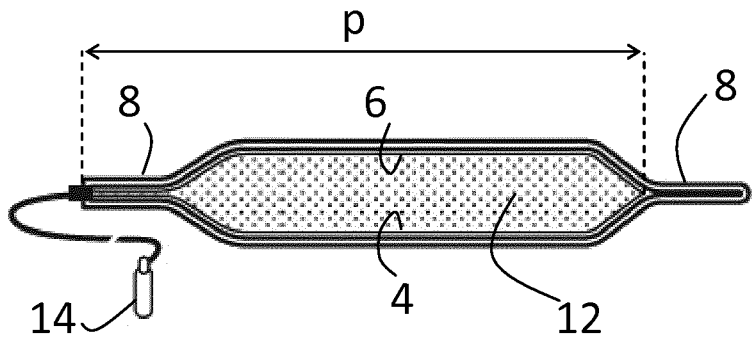
Figure 5:
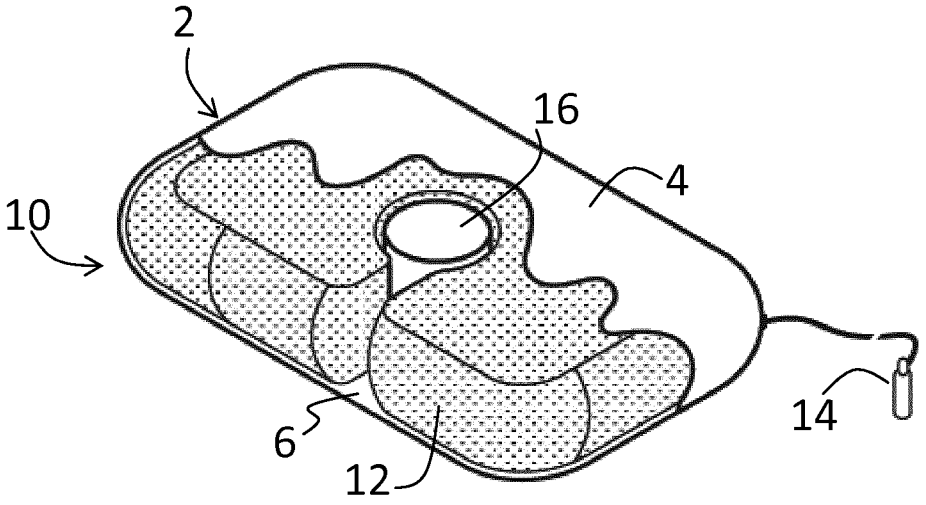

The advantages and the characteristic features of the invention will appear more clearly from the following description of a preferred, but not exclusive, embodiment of a garment with an inflatable protection device with reference to the accompanying figures in which:

FIGS. 1*a* and 1*b* show, respectively, a front view and a rear sectioned view of a first embodiment of a garment according to the present invention in a first operative condition;

FIGS. 2*a* and 2*b* show, respectively, a front view and a rear sectioned view of the garment of FIGS. 1*a* and 1*b* in a second operative condition;

FIGS. 3*a* and 3*b* show, respectively, a front view and a rear sectioned view of the garment of FIGS. 1*a* and 1*b* in a third operative condition and coupled with a further outer garment;

FIGS. 4*a*, 4*b*, 4*c* show schematic sectional views of the inflatable bag of the garment according to the invention, in three different operative conditions;

FIG. 5 show a perspective view of a particular indicated with "A" in FIG. 2*a;*

Figure 6A:
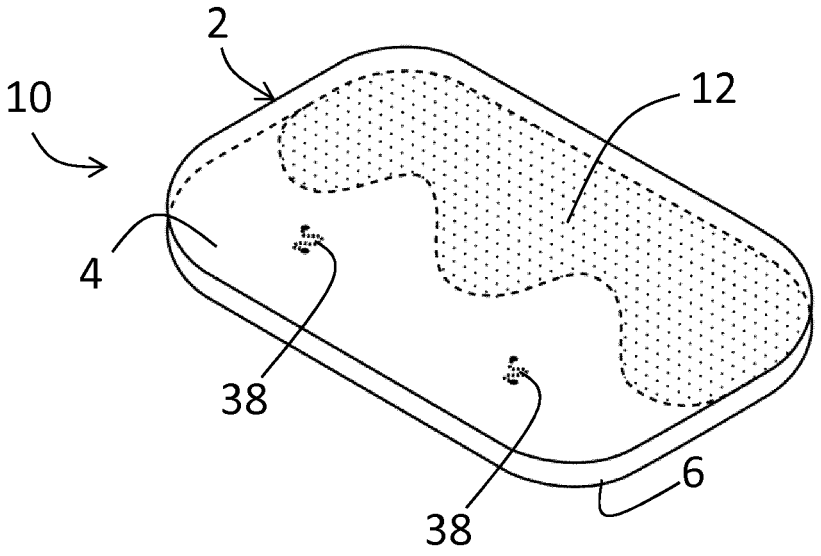
Figure 6B:
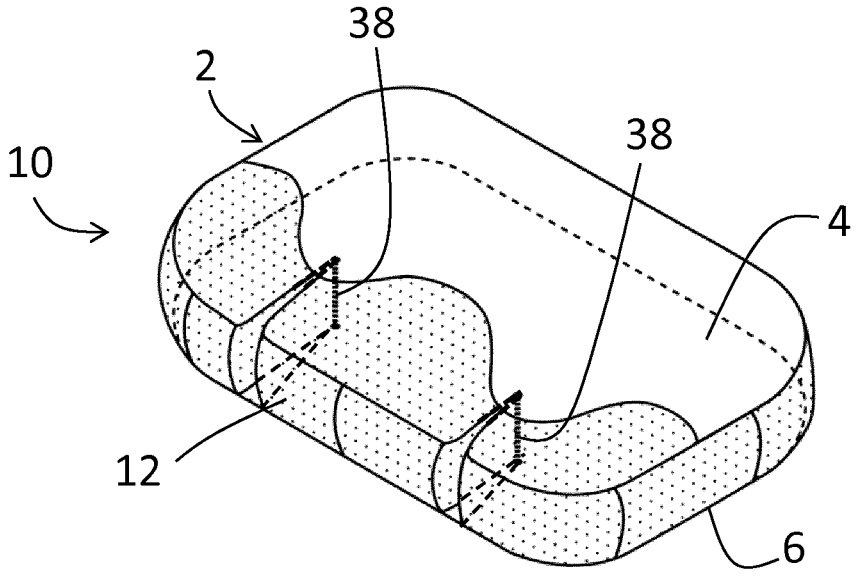

FIG. 6*a* schematically shows a particular of a further embodiment of the garment according to the invention;

FIG. 6*b* shows a figure similar to FIG. 6*a* but in a different operative condition.

DETAILED DESCRIPTION OF EMBODIMENTS OF THE INVENTION

With reference to the attached figures, a garment according to the invention is indicated as a whole with the reference number 1. Preferably, the garment 1 is designed to be worn by motorcyclists or cyclists or used in other fields where an effective protection of the user's body must be obtained.

The garment 1 comprises a housing 2 delimited by a pair of surfaces 4, 6, defining an inner volume (see FIGS. 4*a*, 4*b*, 4*c*). Preferably, the housing 2 is delimited by an inner surface 4 and by an outer surface 6 which can be sealed along their perimetric edges 8.

Alternatively, the housing 2 can be defined between two layers of the garment, for example, between the outer layer and the inner layer, namely the lining, of the garment. In this case, the outer layer and the inner layer of the garment are the inner and outer surfaces 4, 6 of the housing 2.

Additionally, in case the protective garment 1 is formed by an outer jacket or suit and an inner protective vest or suit as shown in FIGS. 3*a* and 3*b*, the housing 2 can be defined between the inner layer of the outer jacket 1B and the outer layer of the inner vest 1A.

The garment 1 further comprises an inflatable protection device, indicated as a whole with the reference number 10.

In turn the inflatable protection device 10 comprises at least one inflatable bag 12 positioned in the housing 2, as illustrated in the attached figures.

In particular the inflatable bag 12 is designed to move between a rest condition, where it is in a deflated status (see FIGS. 1*a*, 1*b*, 4*a* and 6*a*), and an operating condition, where it is in an inflated status (see FIGS. 2*a*, 2*b*, 4*c* and 6*b*).

The inflatable protection device 10 further comprises inflation means 14, connected to the inflatable bag 12 and designed, once triggered, for selectively inflating the bag 12 so as to move it from its rest condition to its operating condition.

When the bag 12 is in the operating condition it provides an additional protection to the user from possible blow or mechanical stresses.

According to the embodiments shown in the enclosed figures, the inflatable bag 12 is suitable for offering an additional protection to the chest, shoulders and back of the user.

The inflatable protection device 10 can also comprise a control unit and a plurality of sensors, not shown in the figures, distributed in the garment 1 or in a vehicle used in conjunction with the garment.

The sensors are connected, in a wired and/or wireless way, to the control unit and are configured to detect data concerning for example movements and accelerations of the wearer.

The control unit is configured to receive the data from the sensors and to selectively trigger the inflation means 14 once a danger situation has been detected.

Alternatively, as it is well known in the art, the inflation means can be mechanically triggered. According to the present invention, the inflatable bag 12 is manufactured with an elastic material. In particular, in its rest condition the inflatable bag 12 is designed to occupy a limited portion of the housing 2, as shown in the FIGS. 1*a*-1*b*, 3*a*-3*b*, 4*a*-4*b* and 6*a*.

Advantageously, thanks to its elasticity, the inflatable bag 12 is able, in its operating condition, to occupy a portion of the housing 2 which is bigger than the portion occupied when it is in its rest condition, as shown in FIGS. 2*a*-2*b*, 4*a*-4*c* and 6*b*.

In particular, the inflatable bag 12, being manufactured with an elastic material, is able to gradually expand, during its movement from the rest condition to the operating condition, inside the volume defined by the surfaces 4, 6 of the housing 2.

As it is schematically shown in FIGS. 4*a*, 4*b* and 4*c*, the portion of the volume defined by the surfaces 4, 6 occupied by the bag 12 gradually increases during inflation of this latter.

Advantageously, the bag 12, once it has reached its final operating condition, substantially occupies all the volume of the housing 2 (see FIG. 4*c*).

Thanks to the great expansion of the bag 12 during its moving from the rest condition to the operating condition, it is possible to leave a large portion of the surfaces 4, 6 of the housing 2 uncovered when the bag 12 is in the rest condition, thus allowing an increased breathability of the garment 1, as shown in FIGS. 1*a*-1*b* and 4*a*.

At the same time, it is assured that the inflatable bag 12, due to its elastic material, in its operating condition is able to completely cover the area of the user body to be protected, without affecting the safety level offered by the garment 1, as shown in FIGS. 2*a*-2*b* and 4*c*.

In FIGS. 4*a*, 4*b* and 4*c* the movement of the bag 12 between its rest condition to its operating condition is illustrated by the reference p, which indicates the projection of the area occupied by the bag 12 on a plane. As shown, the projection increases from the rest condition to the operating condition.

Advantageously, such a behaviour of the inflatable bag 12 is due to the particular elastic material used for its manufacturing. In particular, the material may be chosen in the group comprising elastomers, and more preferably in the group comprising rubber and/or natural rubbers. For example, the inflatable bag 12 can be made with Latex, styrene butadiene rubber (SBR) or nitrile rubber.

As an alternative, the material may be even different from that indicated above, for example polyurethane or PVC, without prejudice to the scope of protection of the present invention, provided that it is an elastic material.

In this regard, despite the type of material used, it is important that the material has an elongation higher than 10% relative to the size of the bag 12 in the rest condition, and more preferably comprised between 30% and 1000%.

In this way, the bag 12 is able to move quickly from its rest condition to its operating condition, reaching at the same an adequate internal pressure, so as to offer the required mechanical resistance.

For example, by making a bag with Latex, namely natural rubber, with a thickness of 0.25 mm it is possible to obtain an elongation of 500% allowing to reach a relative internal pressure of 1.2 bar in less than 100 ms.

As above mentioned, the inflatable bag 12 in the operating condition has a shape complementary to the shape of housing 2, as shown in FIGS. 2*a* and 2*b*. In this regard, the inner and the outer surfaces 4, 6 and the edges 8 define the limit for the expansion of the bag 12.

Moreover, the inflatable bag 12 thanks to its elasticity is also able to wrap and encircle any element, for example a connection element 16, positioned inside the housing 2, as shown for example in the FIGS. 2*a* and 5.

Preferably, the inflatable protection device 10 can comprise a casing inside which one or more inflatable bags 12 are housed. The casing can be made with a breathable material, for example a mesh material.

The casing can coincide with the whole housing 2, described above, or alternatively can be a portion of the housing 2. Alternatively, the casing can be in the form of a closed pocket, not shown in the figures.

Advantageously, the surfaces 4, 6 of the housing 2 or the inner and outer layers of the casing can be connected by means of tie members 38 (see FIGS. 6*a* and 6*b*).

The function of the tie members 38 is to limit the expansion of the housing 2 or of the casing when the inflatable bag 12 is moving between its rest condition (FIG. 6*a*) to its operating condition (FIG. 6*b*). In this way it is assured that the bag 12 does not assume a balloon configuration which could affect the protection offered by the bag 12 to user.

As it is shown in FIG. 6*a*, the tie members 38 can be flexible and they have preferably a thread-like form. Advantageously, the tie members 38 are designed to remain untensioned inside the housing or inside the casing when the inflatable bag is in its rest condition. The tie members 38 are tensioned when the inflatable bag moves from its rest condition to the operating condition (see FIG. 6*b*), so as to limit the distance between the inner surface 4 and the outer surface 6.

The presence of the tie members 38 inside the housing or the casing does not affect the deployment of the inflatable bag which will encircle the tie members during its expansion.

With reference to FIGS. 1*a*-1*b* and 2*a*-2*b*, the garment 1 can consist in a vest 1A. The vest 1A, in its turn, can be designed to be worn alone or coupled with a further outer garment 1B, as shown in FIGS. 3*a*-3*b*.

The vest 1A is designed to cover at least the trunk of the user, when in use.

Moreover, the outer garment may be a motorcyclist jacket 1B, as shown in the FIGS. 3*a* and 3*b*, and the vest 1A may be connected thereto by known fastening means. In this regard, the vest 1A may be used with different types of jackets.

Advantageously, the garment 1 can consist in other types of garments different from the vest or from the jacket shown in the figures, without departing from the scope of protection of the present invention.

Preferably, the vest 1A can comprise a front portion 18 (see FIGS. 1*a*, 2*a* and 3*a*) designed to be positioned at the chest of the user and a back portion 20 (see FIGS. 1*b*, 2*b* and 3*b*) designed to be positioned at the back of the user. Both the front 18 and the back portions 20 have respective housings 2A, 2B for the at least one inflatable bag 12.

The housings 2A and 2B can be in communication to each other, in case the garment is provided with a single inflatable bag.

If the garment is provided with more than one inflatable bag, the housings can be in communication to each other or they can be separated by proper partitions. In this case, a single inflatable bag is positioned inside a corresponding housing.

The control unit and the inflation means 14 may be housed in a protection shell 22 positioned at the back portion 20 of the garment 1, i.e. of the vest 1A, as shown in FIGS. 1*b*, 2*b* and 3*b*.

Advantageously, the vest 1A can be provided with a front zip 24, as shown in FIGS. 1*a* and 2*a*, which can be closed by the user after having inserted the arms into the sleeves. Thus, the vest 1A may have two independent flaps 26, 28, and each of them comprises a portion of the zip 24 for stable connection with the other flap.

The garment can also consist in a motorcyclist jacket 1B alone. The jacket 1B can comprise yielding areas 30 provided in the regions of the armpits and the arms, as illustrated in the FIGS. 3*a*-3*b*. Such yielding areas 30 are preferably made of stretchable material.

In a first embodiment of the present invention, as shown in FIGS. 1*a*-2*b* and 4*a*-4*c*, the housing 2 for the inflatable bag 12 is formed between the inner and the outer layers 4, 6 of the vest 1A.

In alternative, as shown in the FIGS. 3*a* and 3*b*, the housing 2 may be formed between the outer layer of the vest 1A and the inner layer of the jacket 1B.

In this case, one of the surface 4 of the housing 2 is the outer surface of the outer layer of the vest 1A, while the other surface 6 of the housing 2 is the outer surface of the inner layer of the jacket 1B.

In the embodiment wherein the garment is formed by a jacket 1B alone, the housing 2 for the inflatable bag 12 can be formed between the two layers of the jacket 1B, for example, between the outer layer and the inner layer, namely the lining, of the jacket 1B.

Preferably the inflatable bag 12 may be secured to a perimetric portion of the housing 2 or of the casing, as shown in FIGS. 4*a*-4*c*.

Preferably, as shown in FIGS. 1*a* e 1*b*, the end 12A of the inflatable bag 12 may be secured to the upper edge 32 of the vest 1A, in particular in proximity of the neck of the user, as shown in FIG. 1*a*.

Alternatively, the inflatable bag 12 may be freely positioned inside the housing 2 and can be held in position only by the inner and the outer surfaces 4, 6.

In a preferred embodiment shown in the FIGS. 1*a*-1*b*, 2*a*-2*b*, 3*a*-3*b*, the inflatable bag 12 can comprise a front part 36 housed in the housing 2A of the front portion 18 and a back part 34 housed in the housing 2B of the back portion 20.

In particular, the back part 34 of the inflatable bag 12 is a single piece, while the front part 36 of the inflatable bag 12 comprises two pieces 36A, 36B, each independent and one for each of the flaps 26, 28 of the vest 1A, as shown in FIGS. 1*a* and 2*a*.

In the figures, the two pieces 36A, 36B from the front part 36 of the inflatable bag 12 have a lobe shape in the rest condition but they can also have a different shape without prejudice to the scope of protection of the present invention.

At this point of the disclosure it is clear how the predefined objects are achieved with the garment provided with the inflatable protection device according to the invention.

As a matter of fact, the inflatable protection device of the present invention comprises an inflatable bag which, thanks to the elastic material used for its manufacturing, is able to greatly expand once inflated.

In this way, the inflatable bag can advantageously cover a limited portion of the garment when it is in the rest condition, assuring an improved breathability of the garment and allowing to reduce the weight of it.

At the same time, the inflatable bag is able to rapidly reach a shape which assures the required protection to the user's body.

Further, due to the provision of tie members, the housing of the garment can control the expansion of the inflatable bag, so as to avoid the latter to assume a balloon configuration.

With regard to the embodiments of the garment with the inflatable protection device described above, the person skilled in the art may, in order to satisfy specific requirements, make modifications to and/or replace elements described with equivalent elements, without thereby departing from the scope of the accompanying claims.

The invention claimed is:

1. A garment comprising an inflatable protection device and a housing delimited by an inner surface and an outer surface, said inflatable protection device comprising:

at least one inflatable bag housed in said housing and moveable between a rest condition in a deflated status and an operating condition in an inflated status;

an inflation means connected with said at least one inflatable bag and triggerable for selectively inflating said at least one inflatable bag; and at least one casing designed for housing said at least one inflatable bag, the at least one casing coinciding with at least a portion of the housing;

wherein said at least one inflatable bag is manufactured with an elastic material so that in the operating condition, a size of said at least one inflatable bag is subjected to an expansion, the housing being of a larger size than the at least one inflatable bag in the rest condition so as to accommodate any expansion of said at least one inflatable bag ranging from between 30% and 1000% greater than said at least one inflatable bag in the rest condition;

wherein said at least one inflatable bag when in said rest condition occupies a limited portion of said housing, whereby a portion of the inner and outer surfaces defining the housing are uncovered by the at least one inflatable bag;

wherein a projection of the at least one inflatable bag on a plane increases from the rest condition to the operating condition; and wherein the casing is made of breathable material, so as to permit passage of air through coinciding inner and outer surfaces of the housing that are uncovered by the at least one inflatable bag when said at least one inflatable bag is in the rest condition.

2. The garment according to claim 1, characterized in that said at least one inflatable bag, in said operating condition, occupies a portion of said housing which is bigger than the portion occupied when in the rest condition.

3. The garment according to claim 2, characterized in that said housing has an inner volume, said at least one inflatable bag configured to fill all the volume of said housing in said operating condition.

4. The garment according to claim 3, characterized in that said at least one inflatable bag when in said operating condition has a shape which is complementary to the shape of said housing.

5. The garment according to claim 1, characterized in that said elastic material comprises one or more types of rubber.

6. The garment according to claim 5, characterized in that said one or more types of rubber is natural rubber.

7. The garment according to claim 1, characterized by comprising a front portion configured to be positioned at the chest of the user, and a back portion configured to be positioned at the back of the user, said front and back portion having respective housings.

8. The garment according to claim 7, characterized in that said at least one inflatable bag comprises a front part housed in the housing of the front portion and a back part housed in the housing of the back portion.

9. The garment according to claim 1, characterized by comprising at least one tie member positioned in said housing and connected to said pair of surfaces to prevent the expansion thereof once the at least one inflatable bag has been inflated.

10. The garment according to claim 1, characterized in that the inner and outer surfaces of the housing are connected by means of at least one flexible tie member.

11. The garment according to claim 10, further comprising a plurality of tie members, wherein said tie members are designed to remain untensioned inside the housing when the at least one inflatable bag is in its rest condition and wherein said tie members are tensioned when the at least one inflatable bag moves from its rest condition to the operating condition, thereby limiting a distance between the inner surface and the outer surface of the housing.

12. The garment according to claim 11, characterized in that said plurality of tie members are arranged in a row.

13. The garment according to claim 11, characterized in that when the at least one inflatable bag moves into the operating condition said at least one inflatable bag wraps and encircles one or more tie members and/or connection elements positioned inside the housing, the at least one inflatable bag assuming a finger or wave shape when in the operating condition.

14. The garment according to claim 11, characterized in that when the at least one inflatable bag moves into the operating condition said at least one inflatable bag assumes a planar shape.

15. The garment according to claim 1, characterized in that the inner and outer surfaces of the housing are sealed along their perimetric edges.

16. The garment according to claim 1, characterized in that the casing is made with a mesh material.

17. The garment according to claim 1, wherein the at least one inflatable bag of the garment comprises a plurality of inflatable bags, the plurality of inflatable bags being arranged inside corresponding housings delimited by partitions provided in the garment.

18. The garment according to claim 1, wherein said garment comprises a first front flap and a second front flap, wherein said at least one inflatable bag comprises a front part having two independent portions, one front portion of the at least one inflatable bag being arranged at the first front flap of the garment and one front portion of the at least one inflatable bag being arranged at the second front flap of the garment.

19. The garment according to claim 18, characterized in that said front portions of said at least one inflatable bag have a lobe shape.

* * * * *